US005755981A

United States Patent [19]

Payne

[11] Patent Number: 5,755,981

[45] Date of Patent: May 26, 1998

[54] BRIDGE OVERHANG SYSTEM FOR CONNECTING FORMS FROM ABOVE A GIRDER BEAM

[76] Inventor: Jim H. Payne, 260 Crystal River Dr., Lawrenceville, Ga. 30243

[21] Appl. No.: 400,341

[22] Filed: Mar. 8, 1995

[51] Int. Cl.[6] ..... E04G 11/38; E04G 11/48

[52] U.S. Cl. ..... 249/24; 249/23; 249/155; 249/158; 249/219.1

[58] Field of Search ..... 249/19, 23, 24, 249/28, 29, 25, 219.1, 155, 158

[56] References Cited

U.S. PATENT DOCUMENTS

| | | | |
|---|---|---|---|
| 3,782,675 | 1/1974 | Boll et al. | 249/23 |
| 3,806,074 | 4/1974 | Ward | 249/24 |
| 3,993,279 | 11/1976 | Holt | 249/23 |
| 4,159,100 | 6/1979 | Landowski | 249/219.1 |
| 4,422,617 | 12/1983 | Gallis | 249/189 |
| 4,660,800 | 4/1987 | Horstetter | 249/24 |
| 5,058,855 | 10/1991 | Ward | 249/219.1 |
| 5,083,739 | 1/1992 | Shook et al. | 249/24 |
| 5,083,740 | 1/1992 | Sawyer et al. | 249/219.1 |

OTHER PUBLICATIONS

Symons, *Bridge Deck Forming System*, pp. 2 and 3.
Deer River Corporation, *Bridge Deck Overhang System Application Guide*, 1992 (four pages).
Dixie Contractor, *Reusable forms over Choctawhatchee Bay*, May 4, 1992, pp. 8 and 9.
United Forming Drawings (Six drawing pages), Jul. 27, 1994.
Meadow Steel Products, Med Co, *Forming Hardware For Bridge Decks*, 1989.
Symons, *Bridge Overhang Brackets*, 1992.
Dayton Superior, *Bridge Deck Forming Handbook*, cover page, p. 3 (Index), and pp. 12–63, 1985.
Photographs 1A (Nut and Screw) and 1B (connected Nut and Screw).
Concrete Forms Corp, Drawing.

*Primary Examiner*—Khanh P. Nguyen
*Attorney, Agent, or Firm*—Morris, Manning & Martin, L.L.P.

[57] ABSTRACT

A bridge overhang system which enables forms to be secured to a bridge girder member without the necessity of a construction worker standing under the girder to secure the form to the girder. More particularly described, a funnel bracket unit connected to the form has guide surface which enables a hanger rod to be guided to a securing member of the overhang bracket unit from above the girder member. The system of the present invention has a support beam with an opening defined therein, a retainer positioned along a surface of the support beam at the opening; and a support rod extending through the support beam to the retainer. The support rod connectably engages the retainer upon insertion of the support rod to the retainer. Additionally, the retainer may include a bracket having a plurality of sides with at least one of the sides being operable for connection to the form to provide support for the form. An engagement member may be positioned between the sides and serve to engage the support rod extended into the engagement member to provide support from the support beam. A guide surface may extend between the sides of the bracket to the engagement member. Preferably, the engagement member is a threaded nut and the guide surface is preferably shaped like a funnel.

8 Claims, 9 Drawing Sheets

BRIDGE OVERHANG SYSTEM FOR CONNECTING FORMS FROM ABOVE A GIRDER BEAM

FIELD OF THE INVENTION

Generally, the present invention relates to bridge construction and more particularly to a system for connecting concrete forms to a girder beam.

BACKGROUND OF THE INVENTION

In the construction industry, providing support and frame work for supporting a structure is an integral part of the business. Positioning or placing the necessary frame work for supporting a structure can be costly, time consuming, and unsafe. Many ways for constructing the necessary support, frame work, and devices for a structure have been devised.

In the bridge construction industry, forming the concrete bridge deck is a critical aspect of constructing the bridge. The bridge deck is formed by aligning bridge deck forms along concrete or steel girders that generally have upper and lower flanges that yield a cross section shaped in the form of an "I" and hence are called I-beams. Girders with upper flanges extending farther than the lower flanges of I-beam girders are often referred to as Bulb-T girders. The I-beams are aligned so that the length of the I-beams follow the path of the road that the bridge or bridge deck connects. The bridge deck forms are placed between spaced apart I-beams at the upper flange of the I-beam to form a path over which the bridge deck will be overlaid. Forms may be aligned so that the upper surface of the form provides a flat surface even with the I-beam for the laying of the bridge deck. This flat surface may also extend above the upper flange of the I-beam, generally known as the haunch, so as to allow for the camber in the beam.

Attached to and supporting the bridge deck forms from underneath are bridge deck overhang brackets. Because parts of the bridge deck extend beyond the I-beams at the outer edges of the bridge deck, overhang brackets that support the forms for constructing the outer edges of the bridge deck are referred to as overhang brackets. The bridge deck overhang brackets are generally tubular structures which are triangular in shape and have one side of the overhang bracket attached to the lower surface of the form. The angle created by the other two tubes or sides of the overhang bracket provides a point which supports the overhang bracket from underneath. The lower support point or foot of the overhang bracket presses against the lower flange of the I-beam or the vertical section of the I-beam.

Typically, before the form is positioned along the I-beam, the bridge deck overhang brackets are connected to the form to form a single unit which is positioned along the I-beam as a unit. Methods for positioning overhang brackets along an I-beam include using a crane or requiring a construction worker to physically lift the overhang bracket in place. In each of these methods a construction worker goes beneath the bridge to secure the bracket to the I-beam or a construction worker reaches over the edge of the upper flange and threads a hanger rod from underneath. When using a crane, the crane positions the overhang bracket and form unit in the appropriate area for attachment to the I-beam. When the crane positions a overhang bracket and form unit along the I-beam, a construction worker goes underneath the I-beam or bridge deck area to help align the overhang bracket and form unit in the correct position. Depending upon the working environment, the construction worker may stand on a scaffold underneath the bridge structure or stands in a boat underneath the structure. From this position, the construction worker helps to guide the overhang bracket and form unit in place. In order to secure the overhang bracket and form unit in place, the construction worker connects the overhang bracket and form unit to a hanger rod extending down from the edge of the upper flange of the I-beam. The hanger rod provides vertical support for the unit over the edge of the upper flange of the I-beam.

Hanging an overhang bracket and form unit by the conventional method requires a construction worker to go under the bridge. As noted above, a scaffold may have to be constructed and moved to various positions along the I-beam structure under the unit to be attached in the appropriate place. Also, depending upon the environment, the worker may be required to stand in a boat if the bridge is being constructed over water. It can be time consuming and costly to reposition a boat or a scaffold for each overhang bracket and form unit to be attached along the I-beam for the bridge structure. Thus, there is a need in the art to provide a system in which the overhang bracket and form unit may be guided into an appropriate position and attached to the I-beam structure from above the girder structure, thus removing the necessity of requiring a construction worker to stand beneath the bridge to attach the overhang bracket and form unit to the girder.

SUMMARY OF THE INVENTION

Generally described, the present invention provides a bridge overhang system which enables forms to be secured to a bridge girder member without the necessity of a construction worker standing under the girder to secure the form to the girder.

More particularly described, a bracket or overhang bracket unit connected to the form has a guide surface which enables a hanger rod to be guided to a securing member of the overhang bracket unit from above the girder member. The system of the present invention has a support beam with an opening defined therein, a retainer positioned along a surface of the support beam at the opening, and a support rod extending through the support beam to the retainer. The support rod connectably engages the retainer upon insertion of the support rod to the retainer.

Additionally, the retainer may include a bracket having a plurality of sides with at least one of the sides being operable for connection to the form to provide support for the form. An engagement member may be positioned between the sides and serve to engage the support rod extended into the engagement member to provide support from the support beam. A guide surface may extend between the sides of the bracket to the engagement member. Preferably, the engagement member is a threaded nut and the guide surface is shaped like a funnel.

Additionally, the engagement member and guide surface connected thereto may be positioned in an assembly which permits adjusting movement of the guide surface to an appropriate position for receiving the support rod. In this assembly, the guide surface has guide edges extending from the side of the guide surface. The assembly has a guide bracket defining a cavity or tracks for slidably engaging the edges of the guide surface. The guide bracket preferably has an opening defined in the assembly so that the guide surface may extend through the opening. The edges of the guide surface are positioned within the cavity such that the support rod may extend through to the engagement member. The engagement member is thus adjustable within the cavity along the edges of the guide surface.

Additionally, a frame member may be connected to the form and braced against the support beam to provide support to the form from below the form. The frame member is preferably triangular in shape and has a horizontal member extending horizontally from the bracket, a vertical member extending vertically from the bracket, and a diagonal member connected to the ends of the horizontal and vertical members that are not connected to the bracket. The form is preferably connected to and parallel with the horizontal member. Also, the system of the present invention may have a slope adjustment. The horizontal and diagonal members are slidably connected along the axis of the horizontal member, thereby enabling a slope adjustment to the frame and the form. In addition to the slope adjustment, the present invention may have a horizontal adjustment for correcting the horizontal position of the form. The horizontal adjustment includes an extension extending vertically upward from the horizontal frame member, and an adjustment screw threaded through and extending from the extension. The adjustment screw extends parallel to the horizontal member and is rotatably connected to the form and operable to adjust the horizontal position of the form which is slidably connected to the horizontal frame member.

The present invention also provides a method of installing a form on a bridge structure, including the steps of: providing an opening in the support beam, positioning the retainer so that the retainer is roughly aligned with the opening in the support beam, inserting the support rod through the opening to engage the retainer upon insertion of the support rod, and providing an upper support beam to engage the support rod so that the retainer is supported on the support beam.

Thus, it is an object of the present invention to provide a method and system in which a form may be secured in place from above a girder.

It is another object of the present invention to provide a bracket member with a guide surface for guiding a support rod to an engagement member.

It is another object of the present invention to provide an adjustable guide member for receiving a support rod.

It is another object of the present invention to provide horizontal, vertical and slope adjustments for a form connected to a girder.

These and other objects, features, and advantages of the present invention will become apparent from reading the following description in conjunction with the accompanying drawings.

DETAILED DESCRIPTION

Figure 1:
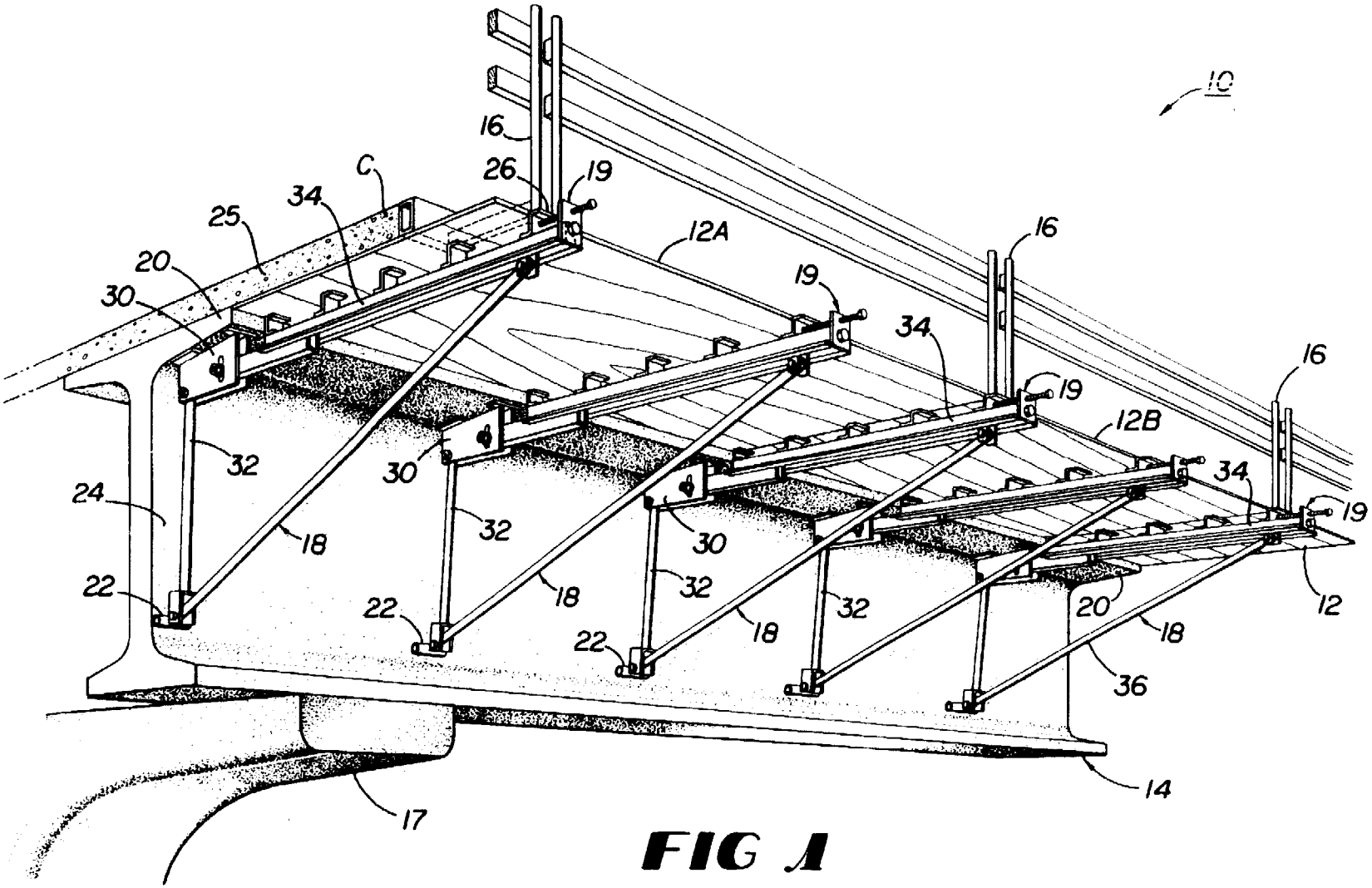
FIG. 1 shows a perspective view of the bridge overhang system of the present invention.

Referring to FIG. 1, a perspective view of the bridge overhang system 10 of the present invention is shown. Bridge deck forms 12A and 12B are shown connected to a Bulb-T girder 14 and are supported by bridge deck overhang brackets 18. The Bulb-T girder is supported by a bridge pier 17. The bridge deck forms have guard rails 16 positioned vertically upward from the bridge deck forms 12A or 12B to prevent workers or construction material from falling over the edge. The bridge deck overhang brackets 18 are connected to the upper flange 20 of the Bulb-T girder 14. A lower support foot 22 of the bridge deck overhang bracket 18 presses against the vertical member 24 of the Bulb-T girder 14. As noted above, the bridge form overhang brackets 18 are connected as a unit to the bridge deck forms 12A and 12B and are transported into position as shown. A connected overhang bracket 18 and bridge deck form 12 is referred to herein as a overhang bracket-form unit 19. The bridge deck forms 12A and 12B may be connected by a form connection link 26.

Figure 2:
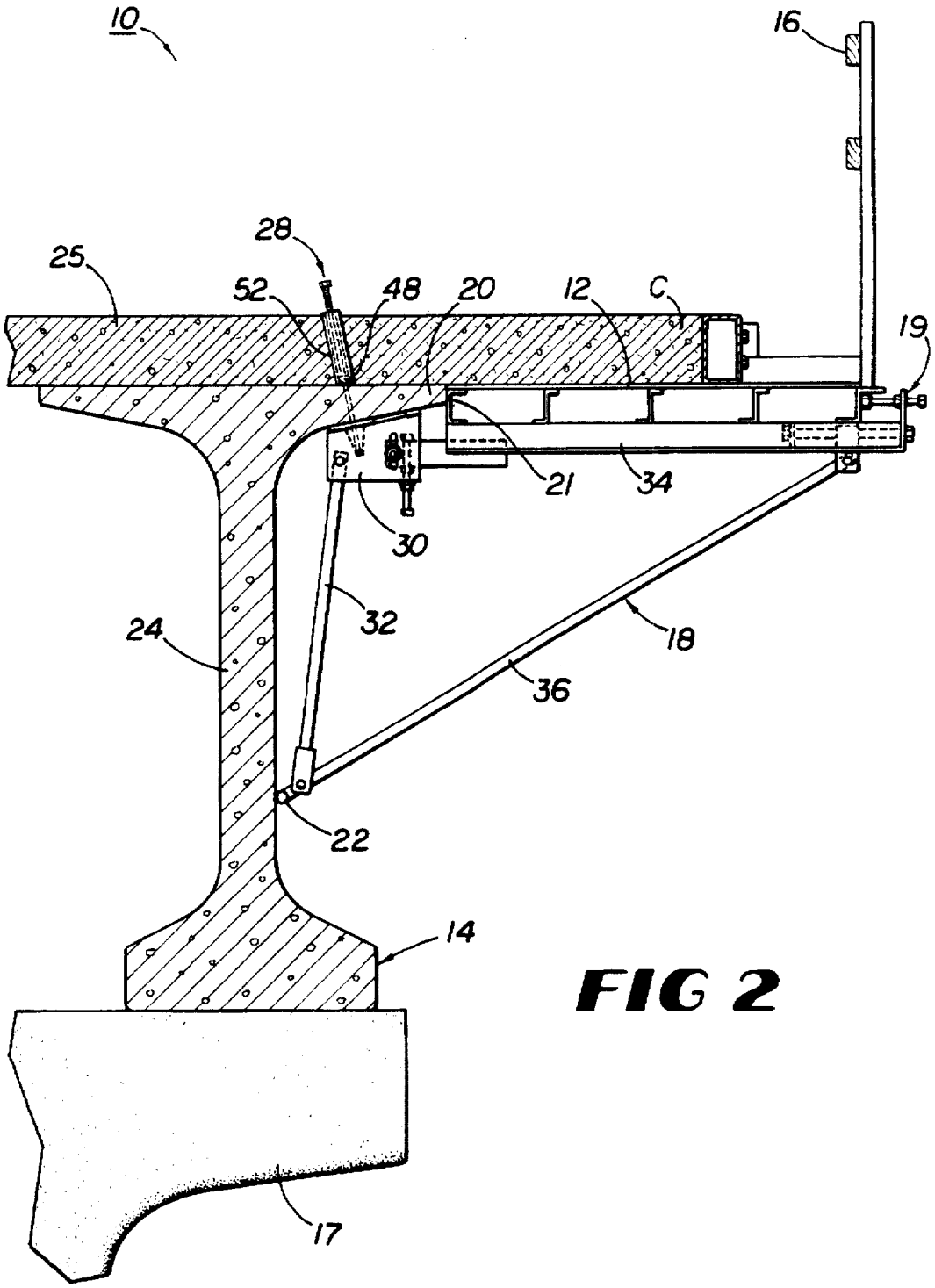
FIG. 2 shows a side view of the bridge overhang system of the present invention.

As noted above, the present invention provides a bridge overhang system 10 which may be connected to a Bulb-T girder 14 from above the Bulb-T girder without the need of a construction worker to go underneath the bridge to attach a fastener to a hanger rod extending from the upper flange of the Bulb-T girder to help support overhang bracket-form unit. Referring to FIG. 2, a cross section of a Bulb-T girder 14, and bridge deck 25, and a side view of the overhang bracket-form unit 19, are illustrated. As noted above, conventional overhang bracket-form units are connected from underneath to the Bulb-T girder 14 by a hanger rod positioned diagonally from an edge 26 of a Bulb-T girder 14 and extending down to the overhang bracket-form unit. Also, in a conventional system a construction worker must stand beneath the overhang bracket-form unit to properly position the hanger rod to secure the overhang bracket-form unit to the flange of a Bulb-T girder. However, as illustrated in FIG. 2, the present invention provides a system in which a hanger rod 28 is extended through an hanger-rod opening 27 in the upper flange 20 of the Bulb-T girder 14 to connect to the bridge overhang bracket-form unit 19 to provide support for the overhang bracket-form unit 19.

By extending the hanger rod 28 through a hanger rod opening 27, the bridge form overhang bracket 18 and thus the bridge overhang bracket-form unit 19 may be connected from above the bridge without requiring a scaffold unit or a boat to be positioned under the bridge to support a construction worker. By securing the overhang bracket-form unit 19 from above, a time efficient and economical system for securing the overhang bracket-form units 19 to a Bulb-T girder 14 for a bridge overhang system 10 is provided.

Figure 3:
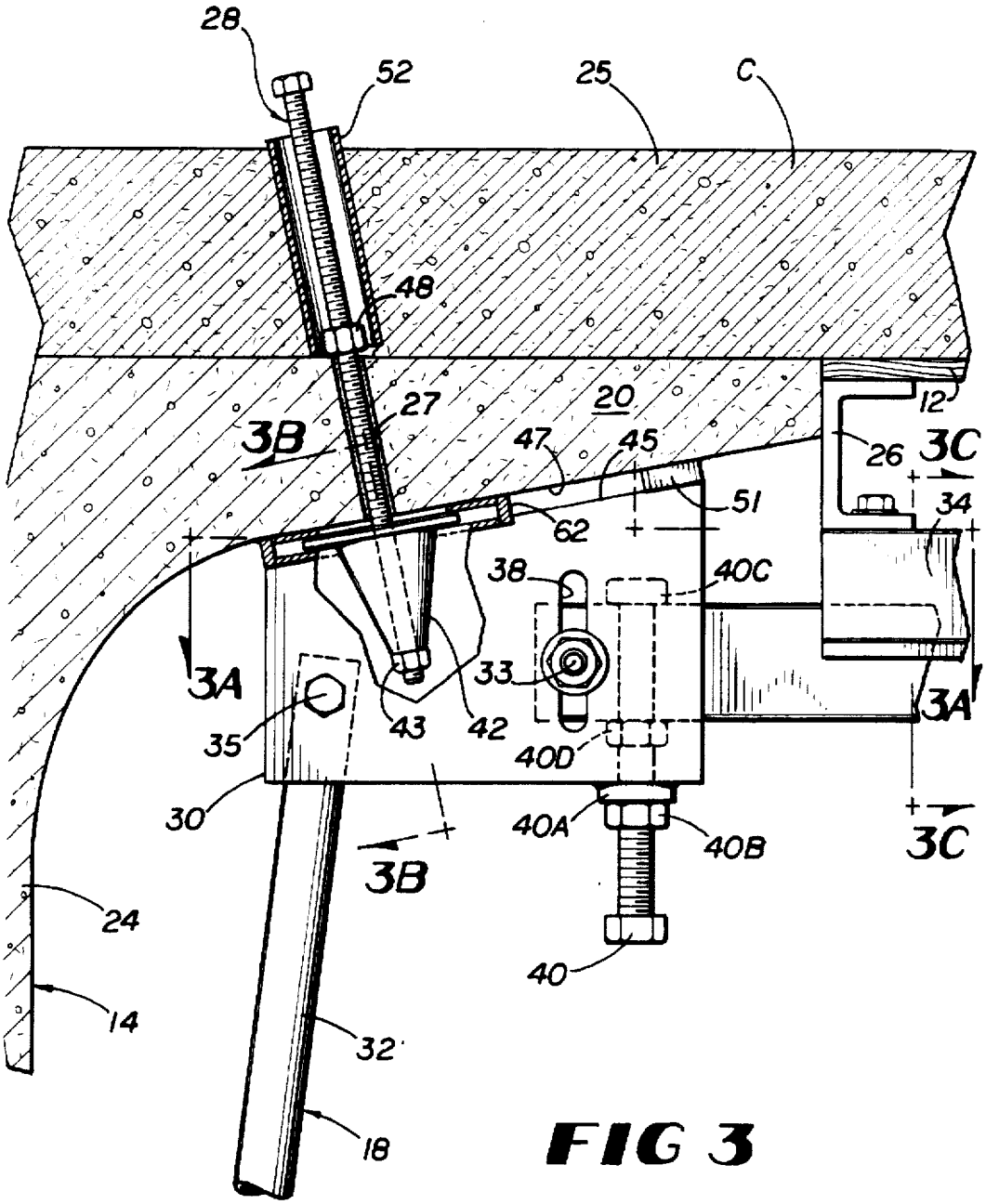
FIG. 3 illustrates the detail of the connections between a funnel nut bracket and a bridge deck support member.
Figure 3A:
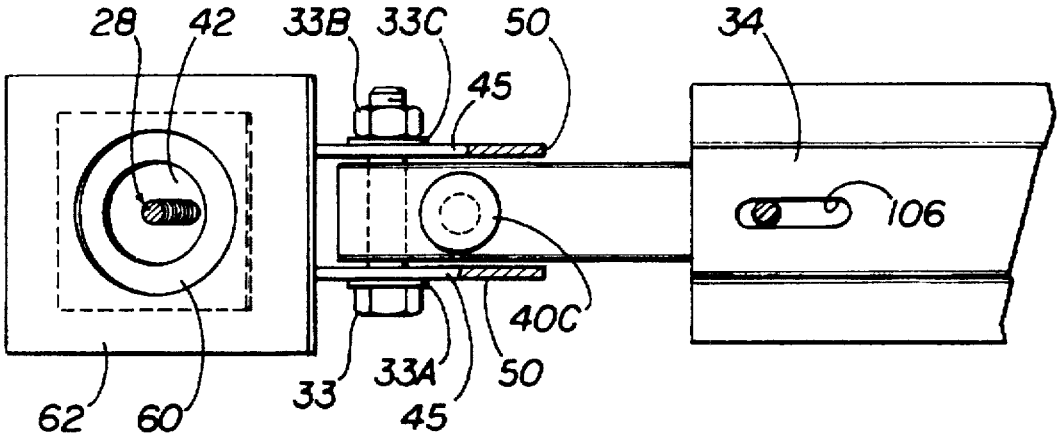
FIG. 3A shows the top view taken along line 3A—3A of FIG. 3.

Referring to FIGS. 2, 3 and 3A a funnel bracket unit 30 performs a key function in enabling the overhang bracket-form unit 19 to be connected to the Bulb-T girder 14 from above. FIG. 3A illustrates a top view taken along line 3A—3A of FIG. 3. The funnel bracket unit 30 is connected at the corner formed by a vertical support leg 32 and a horizontal support leg 34 of the overhang bracket 18. The vertical support leg 32 is connected to the funnel bracket unit 30 by a bolt 35 and the horizontal support leg 34 is slidably connected to the funnel bracket unit 30 through vertical adjustment slots 38 via a screw 33, extending through a washer 33A to the other slot 38 on the opposite side of the funnel bracket 30. A nut 33B and washer 33C secure the screw 33 on the opposite side. A diagonal support member 36 is connected to the lower end of the vertical support leg 32 and to the outward end of the horizontal support leg 34 to form the triangular shaped overhang bracket 18.

As shown in FIG. 3, the hanger rod 28 extends through the upper flange 20 into the funnel bracket 30. A funnel nut member 42 guides and receives the hanger rod 28 from above and serves to retain the rod to provide support for the funnel bracket unit 30. Thus, support is provided to the overhang bracket-form unit 19. The shape of the funnel nut 42 serves to guide the threaded hanger rod 28 to a threaded nut 43 welded to the narrow end of the funnel nut 42. The funnel shaped guide channel of the funnel nut 42 is important to the operation of the funnel bracket unit 30.

Figure 4:
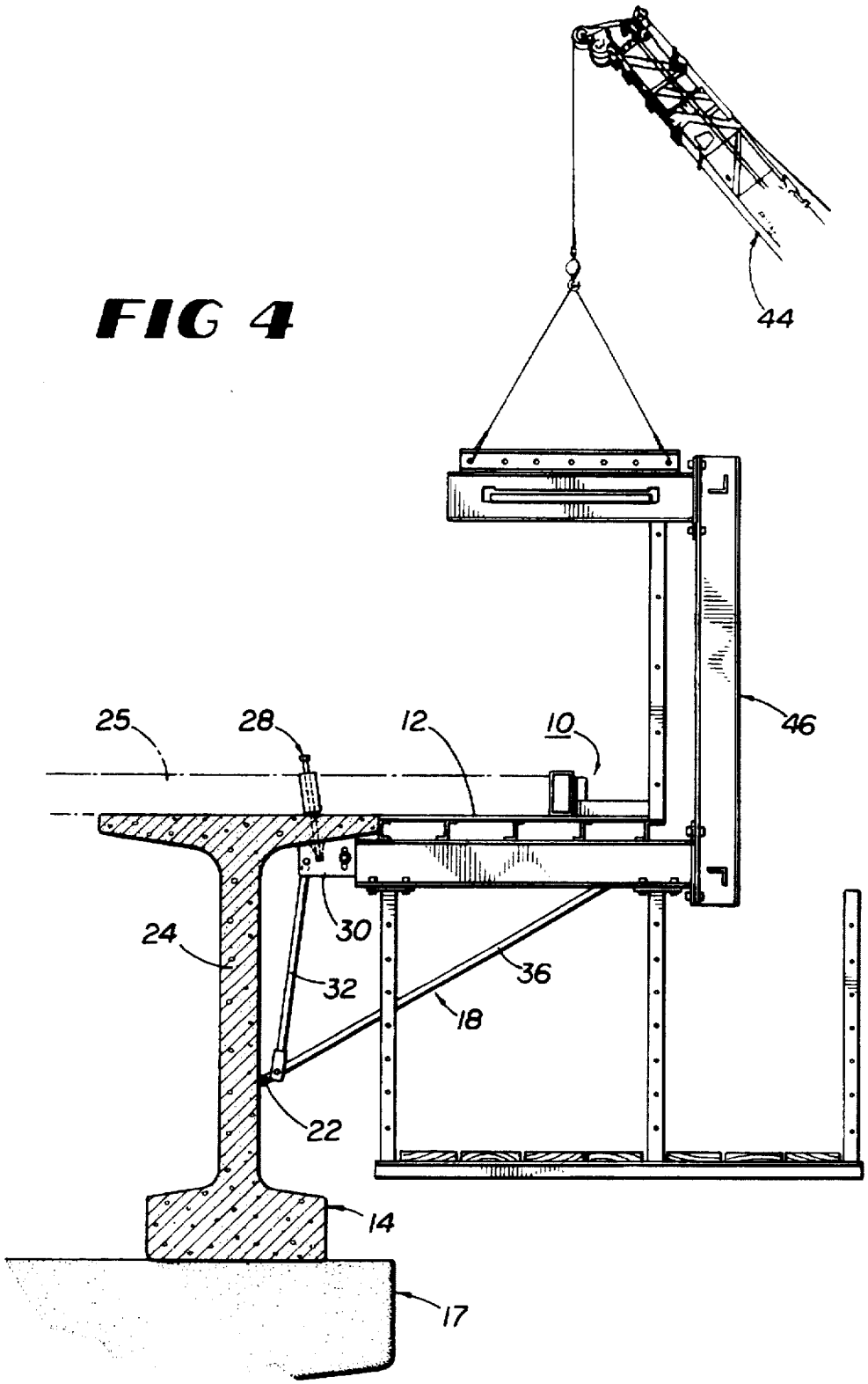
FIG. 4 shows a crane used to lift a device of the present invention into its appropriate place.

By additionally referring to FIG. 4, the importance or significance of the funnel shape guide channel of the funnel bracket 30 may be appreciated. Generally, a overhang bracket-form unit 19 is positioned along the Bulb-T girder 14 through the use of a crane 44. The overhang bracket-form unit 19 is placed on a C-caddy 46 in order to be transported or positioned along the Bulb-T girder 14 by the crane 44. Because the crane is generally not able to hold the C-caddy 46 containing the overhang bracket-form unit 19 perfectly still when a construction worker is attempting to engage the hanger rod 28 through the opening 27 of the flange 20, the guide channel of the funnel nut 42 serves to capture or engage the hanger rod while the C-caddy may be moving. The task of threading the nut 43 is made easier by the guide member.

The hanger rod 28 may be pushed along the guide surface of the funnel nut 42 until it engages the nut 43. A construction worker may then screw the hanger rod 28 through the nut 43 thus securing the overhang bracket-form unit 19 from above through the flange member of the Bulb-T girder 14. A lock nut 48 is placed on the hanger rod 28 from above to support the funnel bracket 30 from above along the surface of the flange 22. The funnel nut 42 funnels the hanger rod 28 to the nut 43 although the C-caddy and overhang bracket-form unit 19 may be somewhat unstable. Thus, the present invention provides an efficient and cost effective system for hanging a bridge deck form 12 from above a Bulb-T girder or bridge deck surface. By utilizing the present invention, a scaffold unit or a boat does not have to be provided under the Bulb-T girder 14 in order to support a construction worker to enable the construction worker to secure the overhang bracket unit to the Bulb-T girder 14.

Referring to FIG. 3, the upper edge or surface 45 of the funnel bracket 30 is generally shaped to fit securely against the lower surface 47 of upper flange 20. Providing a close fit between the surface 45 and 47 helps to add stability to the system. Because Bulb-T girders or I-beams are not generally manufactured with openings for receiving hanger rods, an opening 27 must be created in the flange 20 in order for the hanger rod to be inserted through the flange 20. Thus, implementing the present invention, a construction worker drills a hole through the flange 20 so that a hanger rod 28 may be inserted therein to provide support for the overhang bracket-form unit 19. Care should be taken by the construction worker and engineers on site to ensure that the opening for the hanger rod is positioned far enough back from the edge 26 of the flange to provide ample support for the overhang bracket-form unit 19. It should be appreciated that the manufacturer of the girders or beams can precast the beams or girders with openings defined therein.

In order to be cost efficient and preserve hanger rods 28, the hanger rods 28 are surrounded above the flange 20 by a length of polyvinyl chloride (PVC) tubing 52 to prevent the rod 28 from becoming integrally sealed within the bridge deck 50. After a hanger rod 28 has been inserted through the opening 27 and secured to the funnel bracket 30 via the funnel nut 42, concrete is poured around the tubing 52 and the hanger rod 28 leaving several inches of the hanger rod 28 exposed above the concrete. The hanger rod 28 may be moved relatively easily after the concrete has solidified because the poured concrete does not come in contact with the hanger rod 28. The PVC tubing 52 isolates the rod 28 from the solidified concrete 25. After removal of the rod 28, the opening 27 may be filled with concrete to further solidify the structure.

Figure 3B:
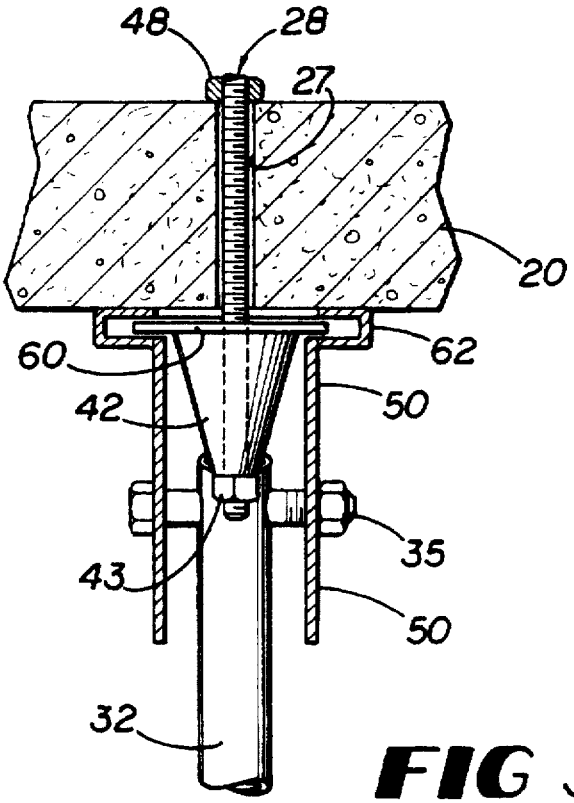
FIG. 3B shows a cross section of the funnel nut bracket unit taken along line 3B—3B of FIG. 3.
Figure 3C:
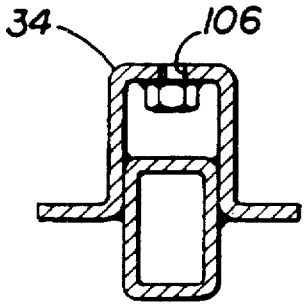
FIG. 3C is a cross section view of a vertical support member used in the present invention taken along line 3C—3C of FIG. 3.

FIG. 3A shows a top view of the funnel bracket 30 taken along line 3A—3A. In FIG. 3A, the side plate members 50 may be seen. The funnel nut 42 forming part of funnel bracket 30 is positioned between and is connected to the top edges 45 of the funnel bracket 30 by a weld. Securing the side plates 50 at the other end of the funnel bracket 30 is a cross-bar plate 51. FIG. 3B shows a cross section of the funnel bracket 30 taken along lines 3B—3B.

In summary, in implementing the present invention the opening 27 is provided in the flange 22 of the Bulb-T girder after which the crane 44 lifts and positions the overhang bracket-form unit 19 into a position so that the funnel nut 42 of the funnel bracket 30 is roughly aligned with the opening 27. The hanger rod 28 is inserted through the opening 27 and guided to the funnel nut 43 by the guide walls of the funnel nut 42. The hanger rod 28 is then screwed through the funnel nut 43 to secure the hanger rod 28 to the funnel bracket 30. A lock nut 48 then is tightened around the hanger rod 28 from above down to the top surface of the flange 22 to secure the overhang bracket-form unit 19 to the Bulb-T girder. The PVC tube 52 is then placed around the hanger rod 28, before concrete is poured over the form but not within the PVC tubing 52. The overhang bracket-form unit may later be released and the hanger rod 28 retrieved from the surrounding structure by unscrewing the hanger rod 28 from the overhang bracket-form unit 19.

Figure 5A:
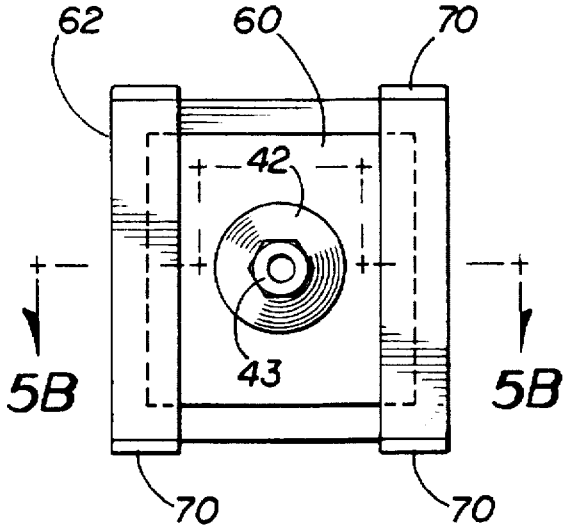
FIG. 5A shows a plan view of the funnel nut with an idler assembly utilized in the present invention.
Figure 5B:
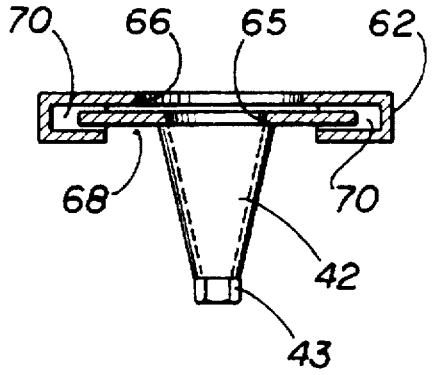
FIG. 5B illustrates a cross section taken along line 5B—5B of FIG. 5A.
Figure 5C:
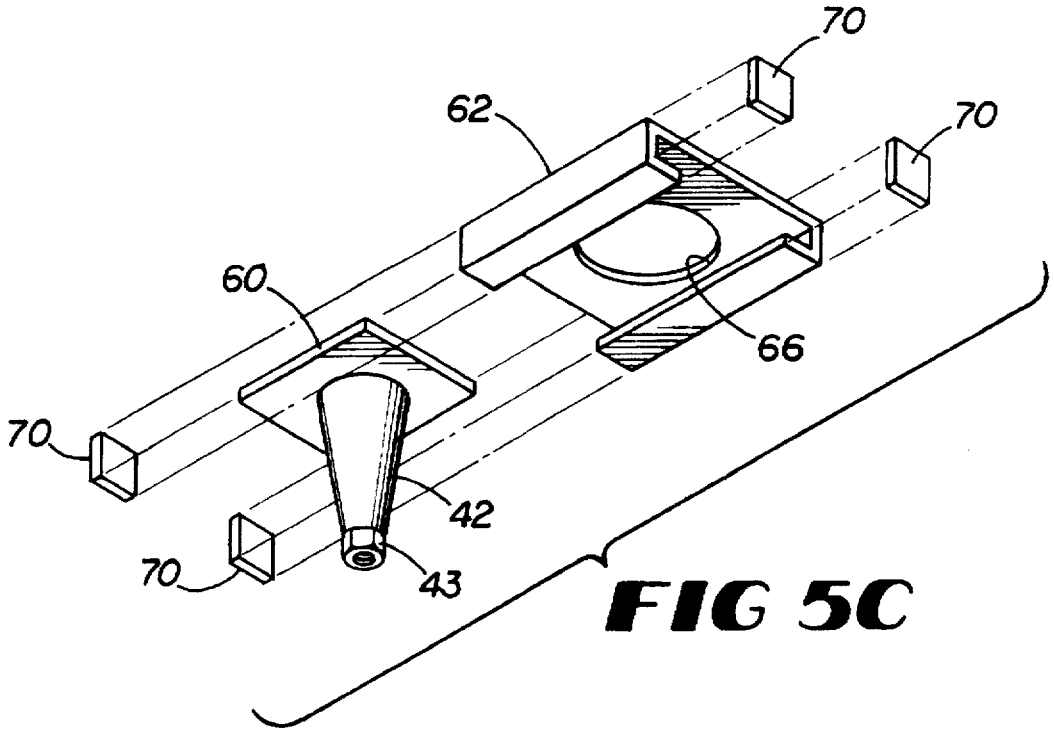
FIG. 5C shows an exploded view of the assembly illustrated in FIG. 5A.

Referring to FIGS. 5A, 5B, and 5C, various views of the funnel nut structure of the funnel bracket 30 are illustrated. FIG. 5A shows a plan view of the funnel nut assembly 42. Funnel nut 42 has a funnel nut guide plate 60 welded to the edge of the funnel nut 42 opposite the nut 43. The funnel nut guide plate 60 is slidably positioned within an idler bracket 62 to provide for a range of motion or adjustment for the funnel nut 42 when a hanger rod 28 is being inserted within the funnel nut from above. The idler bracket 62 defines a cavity 64 for adjustably engaging the guide plate 60 of the funnel nut 42. The idler bracket 62 also has an opening 66 defined on one side of the cavity and an opening 68 defined on the other side of the cavity which permits insertion of the hanger rod 28 through the funnel bracket 30 and into an opening 65 defined by the guide surface or area of the funnel nut 42.

The funnel nut 42 and idler bracket apparatus may be formed by cutting an opening 66 in a sheet of metal then bending opposite edges of the sheet of metal upwards in the same direction. The bent edges are further bent inwards towards each other in a manner which leaves the opening unblocked on either side of the metal sheet. The guide plate 60 of the funnel nut 42 may then slide into the cavity 64 defined by the bent edges of the idler bracket 62. End caps 70 may be placed on the bent edges of the metal sheet to secure the guide plate 60 of the funnel nut 42 within the assembly 42A.

Figure 6:
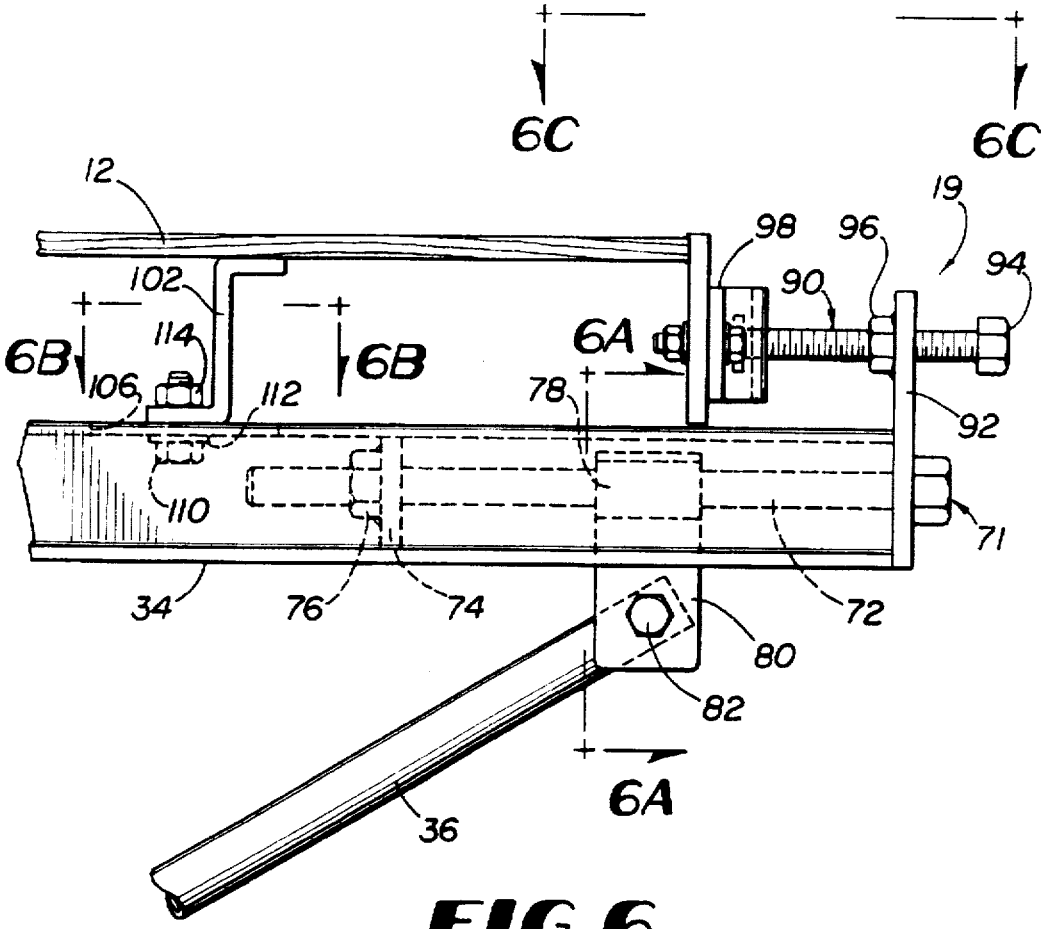
FIG. 6 shows a detailed view of the slope and horizontal adjustment mechanisms utilized in the present invention.

Referring again to FIGS. 2 and 3 along with FIG. 6, the adjustment mechanisms for adjusting the form may be viewed. Referring to FIGS. 2 and 3, the mechanism for aligning or adjusting a form vertically is illustrated. Vertical adjustment of the overhang bracket-form unit 19 is accomplished by adjusting the vertical adjustment screw 40. The vertical adjustment screw is threaded through an opening in a plate **40*a* attached to the side plates 50 of the funnel bracket unit 30. The plate 40*a* has a nut 40*b* welded to it. The screw 40 extends up through the horizontal support bar 34 and is free to rotate. The screw 40 is rotatably retained on the top side of bar 34 with a plate 40*c* connected to the end of the screw and on the bottom side by a nut 40*d* welded to the screw 40**.

Figure 6B:
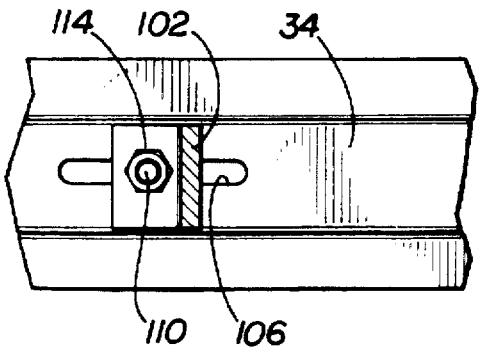
FIG. 6B shows a top view taken along line 6B—6B of FIG. 6.
Figure 6A:
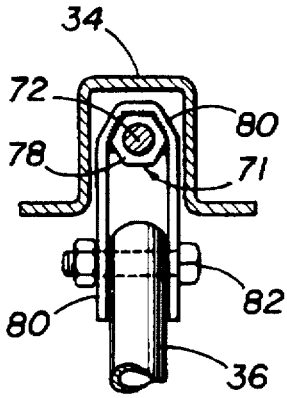
FIG. 6A shows a cross section taken along line 6A—6A of FIG. 6.

Referring to FIG. 6, a detailed view of the slope adjustment and the horizontal adjustments for the overhang bracket-form unit 19 is shown. At the end of the horizontal support bar away from the funnel bracket unit 30, is a slope adjustment mechanism 70. A slope adjustment screw 72 extends within the horizontal support member 34 and rotatably through a vertical end plate 74 which is welded to the inner walls of the horizontal support member 34. A nut 76 on the other end of the slope adjustment screw 72 retains it in place. The slope adjustment screw 72 extends through a slope adjustment nut 78 which is welded to the slope guide plate 80 that is connected to the diagonal support 36 via a bolt 82. Thus, rotating the screw 72 in a clockwise direction causes the nut 78 to move outwardly along the screw 72, in turn causing the end of the member 34 to drop. Opposite rotation causes the end of member 34 to rise. The slope adjustment enables forms to be positioned in a super elevated position or on a slope as necessary. FIG. 6A shows a cross section taken through line 6A—6A.

Figure 6C:
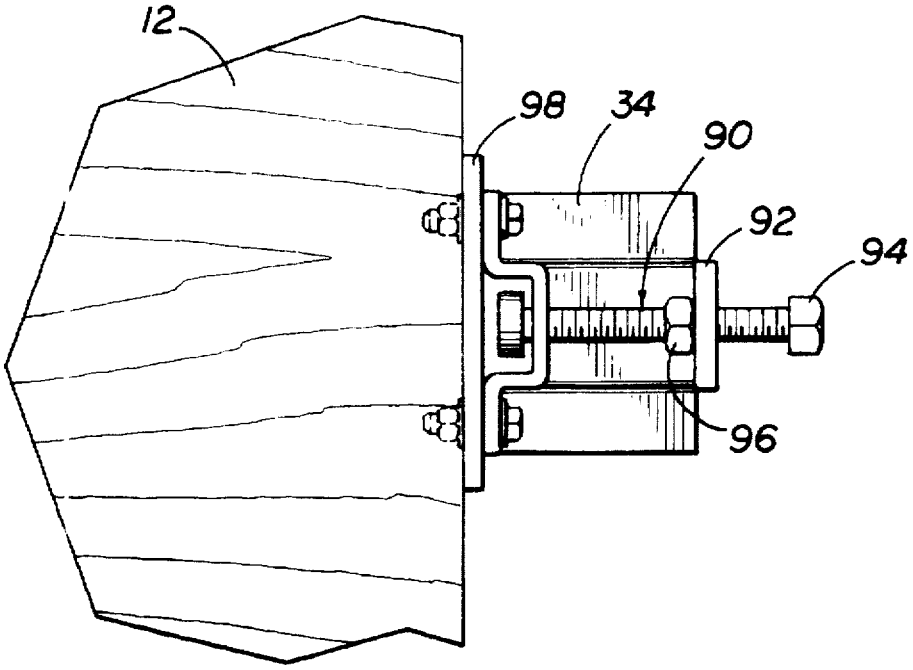
FIG. 6C shows a top view taken along line 6C—6C of FIG. 6.

A horizontal adjustment mechanism 90 enables the horizontal position of the form 12 to be adjusted as needed. The horizontal adjustment mechanism 90 consists of an adjustment plate 92 that has a horizontal adjustment screw 94 extending rotatably through the plate 92 and through horizontal adjustment nut 96. The adjustment nut is welded to the plate 92 at the position at which the horizontal adjustment screw 94 extends through the horizontal adjustment plate 92. The horizontal adjustment screw 94 has an enlarged end (as shown in FIG. 6C) rotatably captured within a collar 98 bolted to the form 12 in order to provide horizontal adjustment for the form 12. The horizontal adjustment screw 72 provides horizontal adjustment for the form eliminating the need for initially setting the forms 12 in an exact position. The horizontal adjustment may also be used when the flange of the bulb-T girder is larger or smaller than planned. Enabling the form 12 to slide horizontally, braces 102, which connect the form structure to the horizontal member 34, are slidably connected with the horizontal member 34 through slots 106 (also shown in FIG. 3A). The braces 102 are connected through the slots 106 by a screw 110, washer 112, and nut 114. A top view of the slot 106 is shown in FIG. 6B which is taken along line 6B—6B. FIG. 6C shows a top view of the connection of the horizontal adjustment screw taken along line 6C—6C of FIG. 6.

Figure 7:
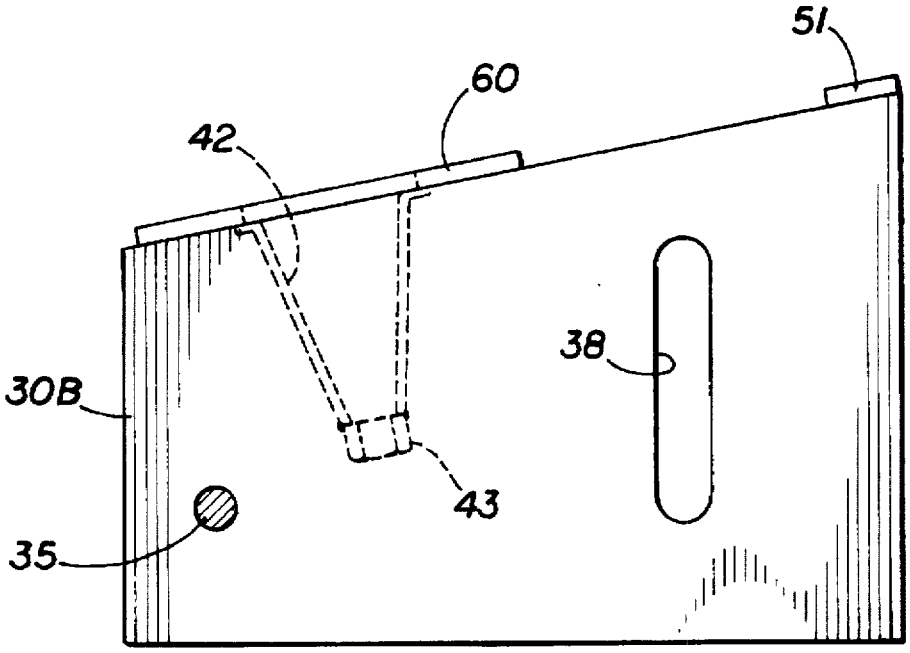
FIG. 7 shows an alternate embodiment of a funnel nut bracket utilized with the present invention.

Referring to FIG. 7, an alternate embodiment of the funnel bracket 30B is shown. In the embodiment illustrated in FIG. 7, the funnel nut guide 60 plate is welded to the funnel bracket 30B without the use of the idler bracket 64 as shown in FIG. 5. In this embodiment the funnel nut 42 does not have as much freedom to move or to be adjusted as in the funnel nut idler bracket assembly shown in FIG. 5.

Figure 8:
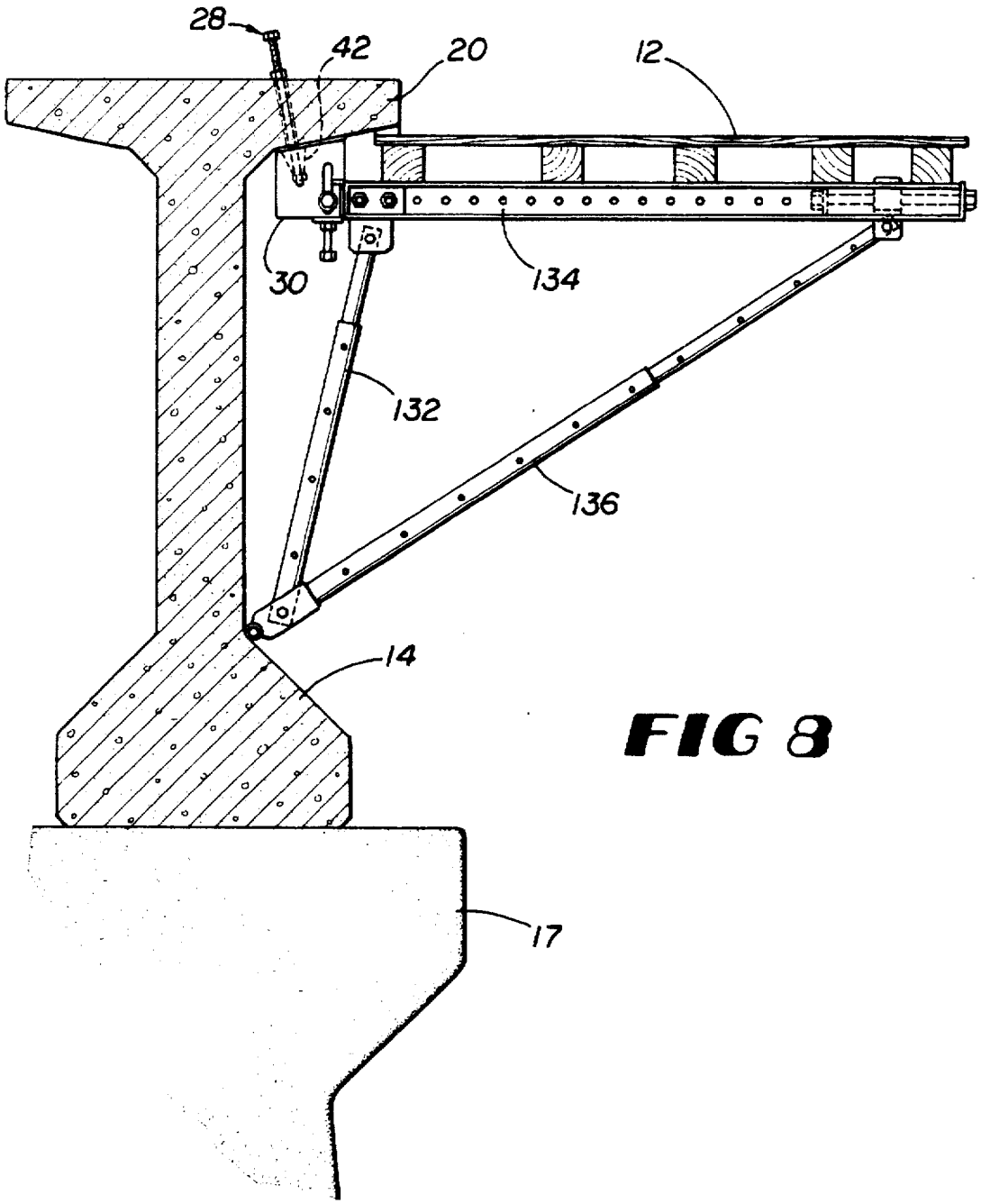
FIG. 8 shows a side view of the funnel nut bracket of the present invention implemented with a conventional bridge overhang bracket.

Referring to FIG. 8, the funnel nut bracket is shown utilized with a standard bridge overhang bracket 180. In the standard bridge overhang bracket, a vertical support leg 132 is connected to a horizontal support bar 134 via a support plate 133. The horizontal bar 134 carries a form 112 which is fixed in a position on the bar 134. The slope and vertical adjustments are present. It should be appreciated that the funnel nut bracket may be adapted to other bridge overhang assemblies with minor modification.

The foregoing relates to the preferred embodiment of the present invention, and many changes may be made therein without departing from the scope of the invention as defined by the following claims.

I claim:

1. A system for hanging a form from a support beam used in bridge construction, comprising:

a bracket unit;

a support beam operative to support said bracket unit for hanging a form and having an opening defined through said support beam;

a retainer operative to secure said bracket unit for hanging said form, said retainer being positioned along a surface of said support beam at said opening;

a support rod extending through said opening of said support beam to said retainer, said support rod connectably engaging said retainer upon insertion of said support rod from the direction of said support beam to said retainer;

said bracket unit having a plurality of sides.

at least one of said sides being operable for connection to said form to provide support for said form;

an engagement member positioned between said sides, said engagement member adapted to engage said support rod extended into said engagement member to provide support from said support beam;

a guide surface connected to one of said sides and extending between said sides of said bracket to guide said rod toward said engagement member;

guide edges extending from the side of said guide surface;

a guide bracket defining a cavity for slidably engaging said edges of said guide surface, said guide bracket having an opening defined therein; and said edges of said guide surface being positioned within said cavity such that said support rod may extend through said opening to said engagement member, and said engagement member being adjustable via said edges.

2. The apparatus of claim 1 wherein said engagement member comprises a threaded nut.

3. The apparatus of claim 2 wherein said guide surface has the shape of a funnel.

4. The apparatus of claim 1 further comprising a frame member connected to said form and braced against said support beam to provide support to said form from below said form.

5. The apparatus of claim 4 wherein said frame member is triangular in shape and has a horizontal member extending horizontally from said bracket and a vertical member extending vertically from said bracket and a diagonal member connected to the ends of said horizontal and vertical members thereby yielding said shape, said form being connected to and parallel with said horizontal member.

6. The apparatus of claim 5 wherein said horizontal and diagonal member are connected by a slidable connection member, said slidable connection members operative to slide along the axis of said horizontal member, thereby enabling a slope adjustment to said frame and said form.

7. The apparatus of claim 5 further comprising an extension extending vertically upward from said horizontal member; and an adjustment rod connected to and extending from said extension, said adjustment rod extending parallel to said horizontal member, said adjustment rod being connected to said form and operable to adjust the horizontal position of said form connected to said horizontal member.

8. A system for hanging a form from a support beam used in bridge construction, comprising:

a support beam operative to support a retainer used for hanging said form;

a support rod for providing support to said form from said support beam;

a retainer positioned along a lower surface of said support beam and connected to said form, said retainer operative to guide said support rod into an engagement position to engage said support rod and said retainer;

said support rod connectably engaging said retainer upon insertion of said support rod to said retainer from above said support beam;

said retainer having a plurality of sides;

at least one of said sides being operable for connection to said form to provide support for said form, an engagement member positioned between said sides, said engagement member for engaging said support rod extended into said engagement member to provide support from said support beam:

a guide surface connected to one of said sides and extending between said sides of said bracket to said engagement member;

guide edges extending from the side of said guide surface;

a guide bracket defining a cavity for slidably engaging said edges of said guide surface, said guide bracket having openings defined at opposite ends of said cavity; and said edges of said guide surface being positioned within said cavity such that said support rod may extend through one of said openings to said engagement member, and said engagement member being adjustable via said edges.

* * * * *